US010073374B2

(12) United States Patent
Ogawa et al.

(10) Patent No.: US 10,073,374 B2
(45) Date of Patent: Sep. 11, 2018

(54) DEVELOPING APPARATUS HAVING MULTI-PART REGULATING MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Yoshinobu Ogawa, Numazu (JP); Ryo Sugiyama, Mishima (JP); Mitsuru Okuda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/658,607

(22) Filed: Jul. 25, 2017

(65) Prior Publication Data

US 2018/0031999 A1 Feb. 1, 2018

(30) Foreign Application Priority Data

Jul. 29, 2016 (JP) ..... 2016-150121

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
USPC ..... 399/284
See application file for complete search history.

(56) References Cited

U.S. PATENT DOCUMENTS

| | | | |
|---|---|---|---|
| 6,148,167 | A | 11/2000 | Komakine et al. |
| 9,442,417 | B2 | 9/2016 | Sunahara et al. |
| 2005/0185974 | A1 | 8/2005 | Terai |
| 2012/0039638 | A1 | 2/2012 | Park |

(Continued)

FOREIGN PATENT DOCUMENTS

| | | | |
|---|---|---|---|
| EP | 2418547 | A1 | 2/2012 |
| JP | S62-105170 | A | 5/1987 |

(Continued)

OTHER PUBLICATIONS

Takaaki Shinkawa et al., U.S. Appl. 15/658,621, filed Jul. 25, 2017.

(Continued)

*Primary Examiner* — Quana M Grainger
(74) *Attorney, Agent, or Firm* — Fitzpatrick, Cella, Harper & Scinto

(57) ABSTRACT

A developing apparatus includes a developer carrying roller rotatable in a first rotating direction, and a developer regulating member which controls a thickness of a developer layer carried on a surface of the developer carrying roller. The developer regulating member has a developer layer thickness regulating part abutting with the surface of the developer carrying roller and a projecting part. The projecting part extends towards an upstream side in the first rotating direction from the abutting part, and a non-contacting gap is formed between the projecting part and the surface of the developer carrying roller. The projecting part has a concave shape at a side facing the developer carrying roller that follows an arc-shaped surface of the developer carrying roller and forms a portion having a gap width H and a continuous length L.

11 Claims, 7 Drawing Sheets

(56) References Cited

U.S. PATENT DOCUMENTS

| | | | | |
|---|---|---|---|---|
| 2015/0043952 | A1 | 2/2015 | Kitan | |
| 2017/0285526 | A1* | 10/2017 | Seki | G03G 15/0881 |

FOREIGN PATENT DOCUMENTS

| | | | |
|---|---|---|---|
| JP | H07-044018 | A | 2/1995 |
| JP | 2006-251730 | A | 9/2006 |
| JP | 2010-230998 | A | 10/2010 |
| JP | 2013-061366 | A | 4/2013 |

OTHER PUBLICATIONS

Takaaki Shinkawa et al., U.S. Appl. No. 15/658,621, filed Jul. 25, 2017.
Mitsuru Okuda et al., U.S. Appl. No. 15/649,706, filed Jul. 14, 2017.
Jan. 29, 2018 Great Britain Search and Examination Report in British Patent Application No. 1712038.7.

* cited by examiner

DEVELOPING APPARATUS HAVING MULTI-PART REGULATING MEMBER, PROCESS CARTRIDGE AND ELECTROPHOTOGRAPHIC IMAGE FORMING APPARATUS

BACKGROUND OF THE INVENTION

Field of the Invention

The present invention relates to developing apparatuses and process cartridges included in electrophotographic image forming apparatuses, and electrophotographic image forming apparatuses.

Description of the Related Art

Widely known electrophotographic image forming apparatuses include developing apparatuses each including a developer carrying roller and a developer regulating member. The developer regulating member abuts on the developer carrying roller in a developer layer thickness regulating part to form a thin layer of a developer, and perform frictional charge (tribomatic charging) on the developer.

Japanese Patent Application Laid-Open No. 2006-251730 discloses a developer regulating member for controlling the amount of charges of a developer layer to be uniform, wherein a developer intake portion is disposed in a portion upstream of an abutting part with a developer carrying roller in the developer traveling direction to circulate a developer between the surface of the developer carrying roller and the developer intake portion. This developer regulating member facilitates the circulation of the developer between the surface of the developer carrying roller and the developer intake portion, and is effective in providing a uniform amount of charges. Unfortunately, the developer on the developer carrying roller is unlikely to be developed in regions having low image density, particularly in a region of a solid white image. Such a developer will repeatedly receive friction between the developer regulating member and the developer feed roller to increase the amount of charges of the developer. In contrast, the developer on the developer carrying roller is mostly developed in regions having high image density, particularly in a region of a solid black image. This phenomenon increases the difference in the amount of charges of the developer between the region of a solid white image and the region of a solid black image, thus generating ghost images.

SUMMARY OF THE INVENTION

The present invention is directed to providing a developing apparatus which provides a uniform charging state of a developer on a developer carrying roller to reduce the generation of ghost images attributed to the difference in the charging state of the developer on the developer carrying roller. The present invention is also directed to providing a process cartridge and an electrophotographic image forming apparatus which can provide stable electrophotographic images.

According to one aspect of the present invention, there is provided a developing apparatus including: a developer carrying roller rotatable in a first rotating direction, and a developer regulating member which controls the thickness of a developer layer carried on a surface of the developer carrying roller, wherein the developer regulating member has a developer layer thickness regulating part and a projecting part, the developer regulating member has an abutting part with the surface of the developer carrying roller at the developer layer thickness regulating part, and the projecting part has a concave shape at a side facing the developer carrying roller, wherein the projecting part and the surface of the developer carrying roller form a non-contacting gap therebetween at an upstream side in the first rotating direction from the abutting part, and wherein when a width of the gap is defined as H, the gap has a portion where a gap width H satisfies Expression (1):

$$0.05\ \text{mm} \le H \le 0.5\ \text{mm}; \qquad \text{Expression (1)}$$

when a maximum value and a minimum value of the gap width H in the portion are defined as Hmax and Hmin respectively, Hmax and Hmin satisfy Expression (2):

$$H\text{max}/H\text{min} \le 3.0; \qquad \text{Expression (2)}$$

and the portion has a continuous length L which satisfies Expression (3):

$$L \ge 0.8\ \text{mm}. \qquad \text{Expression (3)}$$

According to another aspect of the present invention, there is provided a process cartridge detachably attachable to a main body of an electrophotographic image forming apparatus, and including the developing apparatus. According to further another aspect of the present invention, there is provided an electrophotographic image forming apparatus including the developing apparatus.

According to further another aspect of the present invention, there is provided a developing apparatus including: a developer carrying roller rotatable in a first rotating direction, and a developer regulating member which controls the thickness of a developer layer carried on a surface of the developer carrying roller, wherein the developer regulating member has a developer layer thickness regulating part and a projecting part, the developer regulating member has an abutting part with the surface of the developer carrying roller at the developer layer thickness regulating part, and the projecting part has an inwardly curved surface at a side facing the developer carrying roller, wherein the projecting part and the surface of the developer carrying roller form a non-contacting gap therebetween at an upstream side in the first direction from the abutting part, and wherein when a width of the gap is defined as H, and a maximum value and a minimum value of the gap width are defined as Hmax and Hmin respectively, H, Hmax and Hmin satisfy Expression (1) and Expression (2):

$$0.05\ \text{mm} \le H \le 0.5\ \text{mm} \qquad \text{Expression (1)}$$

$$H\text{max}/H\text{min} \le 3.0; \qquad \text{Expression (2)}$$

and the gap has a continuous length L in the first rotational direction, the continuous length L satisfying Expression (3):

$$L \ge 0.8\ \text{mm}. \qquad \text{Expression (3)}$$

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[Developing Apparatus]

The developing apparatus according to the present invention includes a developer carrying roller, and a developer regulating member which controls the thickness of a developer layer carried on the surface of the developer carrying roller. The developer regulating member has a developer layer thickness regulating part and a projecting part.

The developer regulating member has an abutting part with the surface of the developer carrying roller at the developer layer thickness regulating part. A side of the projecting part facing the developer carrying roller has a concave shape. The projecting part and the surface of the developer carrying roller form a non-contacting gap, hereinafter referred as "gap", at an upstream side in the first rotational direction of the developer carrying roller from the abutting part.

The gap has a portion where a gap width H satisfies Expression (1):

$$0.05\ \text{mm} \leq H \leq 0.5\ \text{mm}. \qquad \text{Expression (1)}$$

A maximum value Hmax and a minimum value Hmin of the gap width H in the portion satisfy Expression (2):

$$H\text{max}/H\text{min} \leq 3.0. \qquad \text{Expression (2)}$$

Furthermore, a continuous length L of the portion satisfies Expression (3):

$$L \geq 0.8\ \text{mm}. \qquad \text{Expression (3)}$$

In the developing apparatus according to one aspect of the present invention, the term "width" of the "non-contacting gap" refers to a distance on a straight line from the center of the developer carrying roller in the radius direction thereof. In other words, it means a distance from the surface of the developer carrying roller to the surface of the projecting part facing the developer carrying roller.

Figure 2:
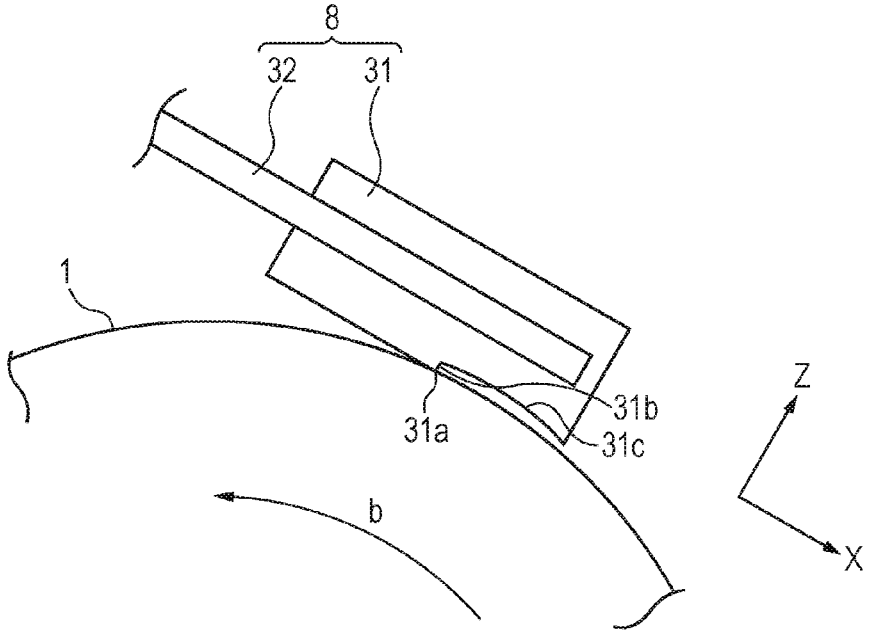
FIG. 2 is a schematic sectional view illustrating an example of the developer regulating member according to the present invention.

The term "abutting part" refers to a portion in which the developer layer thickness regulating part abuts on the surface of the developer carrying roller. A portion at which the developer layer thickness regulating part first abuts on the rotating developer carrying roller is referred to as the "upstream edge" of the abutting part. A portion in which the abutment of the developer layer thickness regulating part and the developer carrying roller ends is referred to as the "downstream edge" of the abutting part. A portion further upstream of the upstream edge of the abutting part is referred to as "upstream of the abutting part." The term "longitudinal direction" refers to a direction parallel to the rotational axis of the developer carrying roller. In FIG. 2, the term "longitudinal direction" refers to a direction perpendicular to the paper. The term "lateral direction" refers to the X-direction in FIG. 2, and the term "thickness direction" refers to the Z-direction in FIG. 2.

[Developer Carrying Roller]

Figure 8:
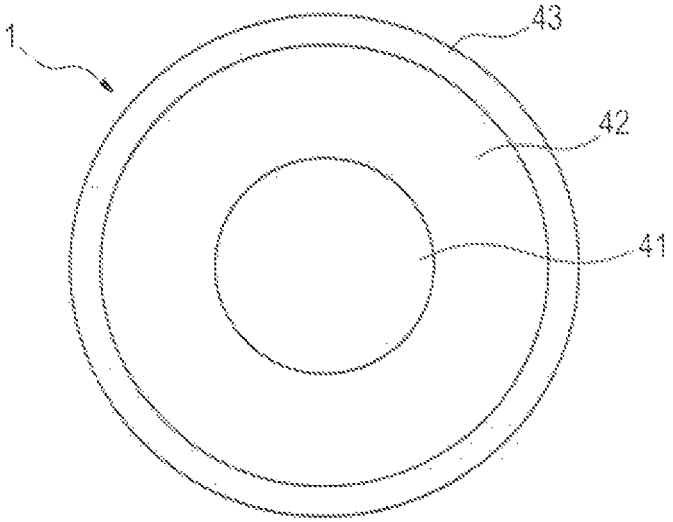
FIG. 8 is a schematic sectional view illustrating an example of the developer carrying roller according to the present invention.

As illustrated in FIG. 8, the developer carrying roller according to one aspect of the present invention includes a cylindrical or hollow cylindrical conductive substrate 41, a conductive elastic layer 42 disposed on the outer peripheral surface of the conductive substrate 41, and a surface layer 43 disposed on the outer peripheral surface of the conductive elastic layer, for example. The developer carrying roller can have any configuration other than the above configuration. A known developer carrying roller can be used.

<Substrate>

The substrate included in the developer carrying roller has conductivity, and supports a conductive elastic layer disposed thereon. Examples of the materials for the substrate include metals, such as iron, copper, aluminum and nickel; and alloys containing these metals, such as stainless steel, duralumin, brass and bronze. To give scratch resistance, the surface of the substrate may be plated in the range not impairing the conductivity. Furthermore, resin substrates having conductive surfaces coated with metals, and those prepared from conductive resin compositions can also be used.

<Electro-Conductive Elastic Layer>

The electro-conductive elastic layer is disposed to provide a developer carrying roller having the elasticity required for the apparatus including the developer carrying roller. The conductive elastic layer specifically may have either a solid body or a foamed body. The conductive elastic layer may include a single layer or a plurality of layers. The developer carrying roller is always pressed against the photosensitive drum and the developer under pressure. To reduce damage of these members mutually given, a conductive elastic layer having low hardness and low compression set is disposed, for example.

Examples of the materials for the electro-conductive elastic layer include natural rubber, isoprene rubber, styrene rubber, butyl rubber, butadiene rubber, fluorocarbon rubber, urethane rubber and silicone rubber. These may be used singly or in combinations of two or more.

The electro-conductive elastic layer may contain conductive agents, non-conductive fillers, and a variety of additive components needed for molding such as crosslinking agents, catalysts and dispersion promoters according to the functions required for the developer carrying roller.

Examples of the electro-conductive agents compounded in the conductive elastic layer include a variety of conductive metals or alloys, conductive metal oxides, fine particles of insulation substances coated with these conductive metal materials, electrically conductive agents such as carbon black, and ionically conductive agents. These electro-conductive agents may be used singly or in combinations of two or more in the form of powder or fibers. Among these electro-conductive agents, carbon black may preferably be used because of its high controllability of the conductivity and low cost. Such an electro-conductive agent can be contained to control the volume resistivity of the conductive elastic layer to be $1\times10^4$ to $1\times10^{10}$ Ω·cm. A developer carrying roller including a conductive elastic layer having a volume resistivity in this range facilitates the control of the amount of the toner to be developed on the photosensitive drum. The electro-conductive elastic layer has a volume resistivity of more preferably $1\times10^4$ to $1\times10^9$ Ω·cm.

Examples of the non electro-conductive fillers optionally contained in the electro-conductive elastic layer include: diatomite, quartz powder, dry silica, wet silica, titanium oxide, zinc oxide, aluminosilicic acid, calcium carbonate, zirconium silicate, aluminum silicate, talc, alumina and iron oxide.

The electro-conductive elastic layer gives the elasticity required for the developer carrying roller. The electro-conductive elastic layer can have an asker C hardness of 10 degrees or more and 80 degrees or less, for example. An electro-conductive elastic layer having an asker C hardness of 10 degrees or more can reduce the compression set caused by each member disposed facing the developer carrying roller. An electro-conductive elastic layer having an asker C hardness of 80 degrees or less can decrease the stress applied to the developer, and can suppress a reduction in image quality caused by repeated formation of images. Herein, the asker C hardness can be specified by the value measured by an asker rubber durometer (manufactured by Kobunshi Keiki Co., Ltd.).

The electro-conductive elastic layer has a thickness of 0.1 mm or more and 50 mm or less, for example. The thickness is more preferably 0.5 mm or more and 10 mm or less.

Examples of the method of molding the electro-conductive elastic layer include a variety of molding methods such as extrusion molding, press molding, injection molding, liquid injection molding and mold injection molding in which the material is cured by heating at an appropriate temperature for an appropriate time to mold a conductive elastic layer over a substrate. In mold injection molding, an uncured material for a conductive elastic layer is injected into a cylindrical metal mold in which a substrate is disposed, and is cured by heating. Such a method enables the molding of the electro-conductive elastic layer around the substrate with precision.

<Surface Layer>

The developer carrying roller may have a layer such as a surface layer on the outer periphery of the electro-conductive elastic layer to have properties needed for the developer carrying roller which transports or charges the developer. The surface layer can be a resin layer to satisfy these properties. Examples of the resin forming the surface layer include fluorinated resins, polyamide resins, melamine resins, silicone resins, urethane resins and mixtures thereof.

The surface layer in use may contain a resin and carbon black, which gives conductivity and reinforcing properties to the surface layer. The amount of carbon black to be compounded can be 3% by mass or more and 30% by mass or less relative to the resin component. The surface layer can be formed as follows: the resin is mixed with carbon black and a solvent, and is dispersed to prepare a coating solution, and the coating solution is applied onto a conductive elastic layer. Any solvent which can dissolve the resin to be used for the surface layer can be used for the coating solution.

The surface layer can have a thickness of 4 μm or more and 50 μm or less. A surface layer having a thickness of 4 μm or more can reduce wear during use. A surface layer having a thickness of 50 μm or less can decrease the stress applied to the developer caused by the surface hardness of the developer carrying roller.

The surface layer can have any surface roughness. The surface roughness of the surface layer can be appropriately adjusted in use to ensure the force to transport the developer and thus obtain images of high quality. An effective method of controlling the surface roughness is that a particle having a desired particle size is contained in the surface layer. The particle used in the surface layer may be a metal particle and a resin particle having a particle size of 0.1 μm or more and 30.0 μm or less. Among these particles, a resin particle is more preferred because of their high flexibility, relatively low specific gravity, and the readily attainable stability of the coating material. If the surface layer includes multiple sublayers, such a particle may be contained in all of the multiple sublayers, or may be contained in at least one layer of these sublayers.

[Developer Regulating Member]

The developer regulating member according to the present invention includes a developer layer thickness regulating part and a projecting part. A side of the projecting part facing the developer carrying roller has an inwardly curved surface. The developer regulating member may comprise includes a blade member and a supporting member in which the blade member has the developer layer thickness regulating part and the projecting part. An example of the developer regulating member is illustrated in FIG. 2. In FIG. 2, a developer regulating member 8 comprises a supporting member 32 and a blade member 31. The blade member 31 has the projecting part 31*c* disposed in the direction of the distal end.

The supporting member and the blade member may be formed of a single material, or may be formed of different materials. Any supporting member which can support the blade member can be used in the developer regulating member. In the present invention, the supporting member and the blade member are not limited to the form of the both being present as individual members separated from each other, and may be in a form in which the both are integrated to be present as a support portion and a blade portion of the developer regulating member.

[Supporting Member]

Any material can be used in the supporting member. Examples of the material include metals such as surface treated steel sheets such as steel sheets subjected to chromate conversion coating, stainless steel, phosphor bronze and aluminum; and resins such as acrylic resins, polyethylene resins and polyester resins. If these resins require conductivity in use, a conductive material can be added to the resins.

The supporting member can have any thickness (distance in the Z-direction in FIG. 2). The thickness can be 0.05 mm or more and 3 mm or less. In particular, because a supporting member in the form of a thin plate having a thickness of 0.05 mm or more and 0.15 mm or less has appropriate spring properties, the blade member can be brought into abutment with the developer carrying roller at an appropriate abutting pressure to control the developer on the developer carrying roller to an appropriate layer thickness. A supporting member having a thickness of 0.8 mm or more facilitates attachment and positioning of the developer regulating member to the developing apparatus, the process cartridge and the electrophotographic image forming apparatus without distortion. Thus, the blade member can be stably brought into abutment with the developer carrying roller at an appropriate abutting pressure.

If the supporting member and the blade member are formed of a single metal material, the supporting member can be molded by a method such as bending, such as pressing, electrochemical machining, electrical discharge machining, or laser beam machining.

A supporting member formed of a thermoplastic resin can be molded by extrusion molding or injection molding, for example. Specifically, in extrusion molding, the thermoplastic resin melted by heating can be injected into a metal mold to mold the resin into a supporting member. In injection molding, the thermoplastic resin can be injected into a metal molding cavity, and be cooled to be molded into a supporting member.

[Blade Member]

Any material can be used in the blade member. Examples of the material include elastic materials such as rubber and thermoplastic elastomers, and a variety of resins. Specific examples thereof include: rubbers having rubber elasticity such as thermosetting polyurethane rubber, silicone rubber and liquid rubber; thermoplastic resins such as polyester resins, polyamide resins and polyether resins; and thermoplastic elastomers such as polyester elastomers, polyurethane elastomers and polyamide elastomers.

If the blade member is formed of a different material from that for the supporting member, the following materials can be used in the blade member: thermosetting resins or rubbers such as silicone resins, silicone rubbers, urethane resins, urethane rubbers, phenol resins, urea resins, melamine resins, acrylic resins and epoxy resins; and thermoplastic resins such as acrylic resins, polyethylene resins, polyamide resins, polyester resins and polyether resins. Among these materials, the thermoplastic resins can be used in molding of the blade member because these resins can be readily deformed into desired shapes.

If the material for the supporting member is different from that for the blade member, the blade member can have any thickness (distance in the Z-direction in FIG. 2). The thickness of the developer layer thickness regulating part can be 10 μm or more and 3 mm or less. In the developer layer thickness regulating part, a blade member having a thickness of 10 μm or more can ensure the durability against abrasion caused by friction with the developer carrying roller while maintaining the elasticity as a resin or a rubber. In the developer layer thickness regulating part, a blade member having a thickness of 3 mm or less with the developer carrying roller can provide a stable abutting pressure.

The blade member may be formed in any place of the supporting member. The blade member may be formed on one surface of the supporting member abutting on the developer carrying roller. The blade member may be formed into a shape so as to cover both surfaces of the supporting member. Examples of the blade member includes a blade member having the developer layer thickness regulating part and the projecting part, the blade member being disposed at one end of the supporting member, and the supporting member extending to the position of the projecting part, as illustrated in FIG. 2.

The blade member may be formed by a method such as metal mold molding, extrusion molding, coating molding, molding by bonding sheets, or injection molding. Specifically, in mold molding or extrusion molding, molding can be performed as follows: a supporting member coated with an adhesive when necessary is disposed in a metal mold, and a resin material melted by heating is injected into the metal mold to be molded into a blade member joined to the supporting member. In molding by bonding sheets, a blade member molded in the form of a sheet by extrusion molding can be bonded to a supporting member coated with an adhesive. In injection molding, the resin material can be injected into a metal molding cavity, and be cooled to be molded into a blade member.

Figure 7:
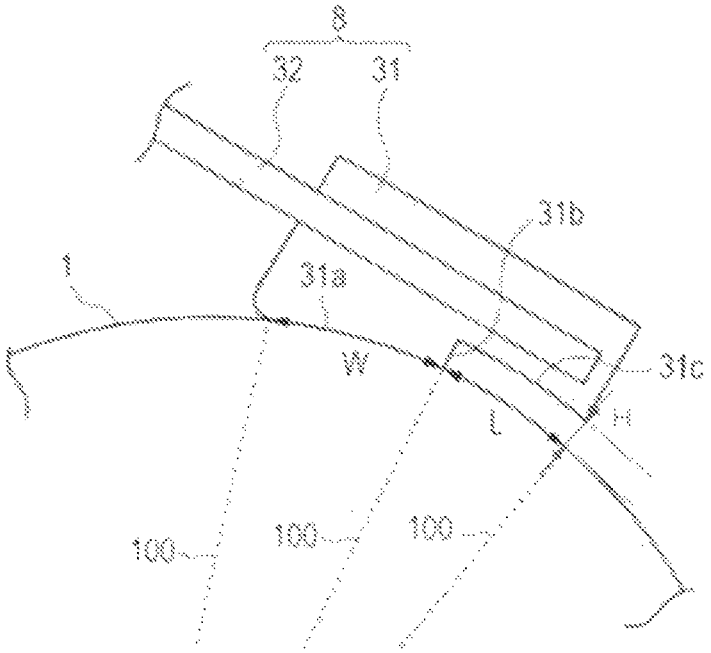
FIG. 7 is a schematic sectional view illustrating the shape of an abutting part.

In the blade member, the developer layer thickness regulating part serving as the abutting part with the developer carrying roller can have a length W in the rotational direction of the developer carrying roller (distance of the arc in FIG. 7) of 1.0 mm or more and 5.0 mm or less. A developer layer thickness regulating part having a curved surface along the surface of the developer carrying roller, as illustrated in FIG. 7, can ensure a long abutting width.

In the formation of the blade member, an adhesive layer may be formed on the supporting member when necessary. Examples of the material for the adhesive layer include hot-melt adhesives such as polyurethane adhesives, polyester adhesives, ethylene vinyl alcohol (EVA) adhesives and polyamide adhesives.

[Conductive Agent]

The supporting member, the blade member and the adhesive layer may contain a conductive agent when necessary. Examples of the conductive agent include ionically conductive agents and electronically conductive agents such as carbon black.

Examples of carbon black specifically include conductive carbon black such as "Ketjenblack" (trade name, manufactured by Lion Corporation) and acetylene black; and carbon black for rubber such as SAF, ISAF, HAF, FEF, GPF, SRF, FT and MT. Besides, carbon black for color ink subjected to an oxidation treatment, and pyrolysis carbon black can be used. Carbon black can be used in an amount of 5 parts by mass or more and 50 parts by mass or less relative to 100 parts by mass of the resin or rubber. The content of carbon black in the resin or rubber can be measured with a thermogravimetric analyzer (TGA).

In addition to carbon black above, examples of usable electronically conductive agents include: graphites such as natural graphite and artificial graphites; powdery metals such as copper, nickel, iron and aluminum; powdery metal oxides such as titanium oxide, zinc oxide and tin oxide; and conductive polymers such as polyaniline, polypyrrole and polyacetylene. These conductive agents can be used singly or in combinations of two or more when necessary.

Examples of the ionically conductive agent include: perchlorates, chlorates, hydrochlorides, bromates, iodates, fluoroboric acid salts, trifluoromethylsulfates, sulfonates and bis(trifluoromethylsulfonic acid)imide salts containing ammonium ions such as tetraethylammonium, tetrabutylammonium, lauryltrimethylammonium, dodecyltrimethylammonium, stearyltrimethylammonium, octadecyltrimethylammonium, hexadecyltrimethylammonium, benzyltrimethylammonium and modified aliphatic dimethylethylammonium; perchlorates, chlorates, hydrochlorides, bromates, iodates, fluoroboric acid salts, trifluoromethyl sulfates, sulfonates and bis(trifluoromethylsulfonic acid)imide salts containing an alkali metal or an alkaline earth metal such as lithium, sodium, calcium or magnesium. Among these, trifluoromethyl sulfates and bis(trifluoromethyl sulfonic acid)imide salts of an alkali metal or ammonium ion can be used. These salts are suitable because these have a structure of an anion containing fluorine, and thus have a large effect of giving conductivity. These salts can be used singly or in combinations of two or more when necessary.

The supporting member, the blade member and the adhesive layer may contain other additives such as a charge control agent, a lubricant, a filler, an antioxidant and an anti-aging agent in the range not inhibiting the functions of the resin or rubber, and the conductive agent.

[Projecting Part]

A side of the projecting part of the developer regulating member facing the developer carrying roller has a concave shape. Specifically, for example, the surface corresponding to the developer carrying roller is inwardly curved. Thereby, a gap satisfying the relationships represented by Expressions (1) and (2) can be ensured over a long distance of the developer carrying roller in the rotational direction relative to the surface of the developer carrying roller. The projecting part may have bent shapes and curve shapes. Curve shapes can be used. Since those curve shapes have no corners, the developer on the side of the surface of the projecting part can be smoothly circulated. Furthermore, the curve shape of the surface of the projecting part can be an arc shape of a circle concentric with a cross-sectional circle of the developer carrying roller. In this case, a gap having a small width relative to the surface of the developer carrying roller can be ensured over a long distance of the developer carrying roller in the rotational direction. Examples of the shape of the projecting part include those illustrated in FIGS. 2 to 7.

As illustrated in FIG. 2, a level difference can be disposed in the boundary between a developer layer thickness regulating part 31*a* and the projecting part 31*c*. A developer densely filled into the gap between the surface of the developer carrying roller and the projecting part 31*c* may lift the surface of the projecting part upwards in some cases. The level difference can ensure the edge portion which controls the thickness of the developer layer, thus reducing the failure of control of the thickness of the developer layer.

Figure 5:
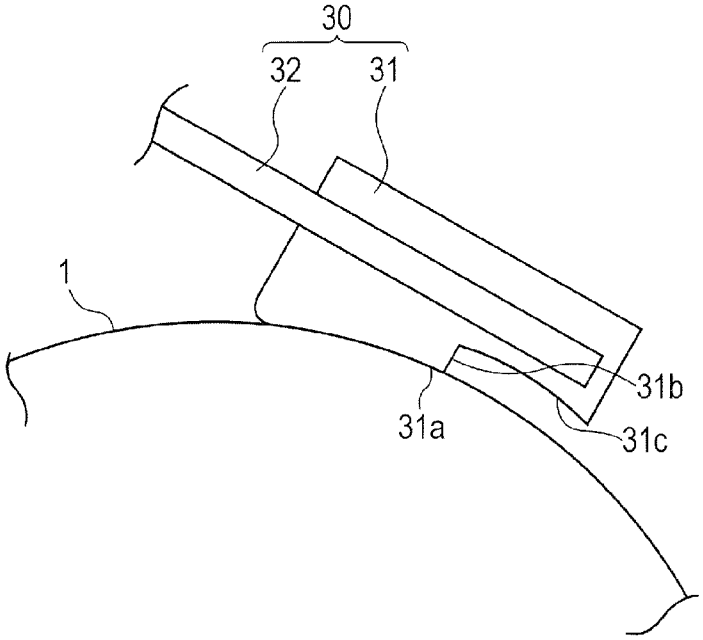
FIG. 5 is a schematic sectional view illustrating another example of the developer regulating member according to the present invention.

The thickness of the developer layer is controlled and the developer is charged by friction between the developer layer thickness regulating part and the surface of the developer carrying roller. The developer layer thickness regulating part may have any of a flat surface, a curve shape, a projected shape or a concave shape. A curve shape is particularly preferred as illustrated in FIG. 5. A developer layer thickness regulating part having a curve shape can increase the frictional distance by the developer layer thickness regulating part and the developer carrying roller to provide a uniformly high amount of charges of the developer. Furthermore, the developer layer thickness regulating part can have a curve shape along the surface of the developer carrying roller.

If the supporting member and the blade member are formed of different materials, the supporting member can extend to the position of the projecting part. A supporting member extending to that position enhances the rigidity of the projecting part, enabling a desired gap to be maintained even if the developer is densely filled into the gap between the surface of the developer carrying roller and the surface of the projecting part.

[Developing Apparatus]

Figure 1:
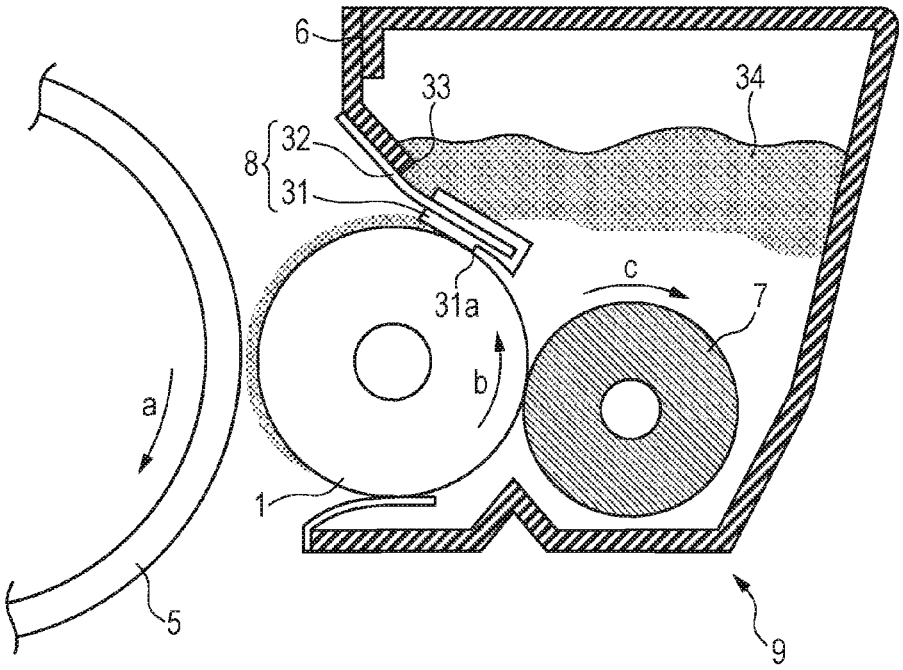
FIG. 1 is a schematic sectional view illustrating an example of the developing apparatus according to the present invention.

An example of the developing apparatus according to one aspect of the present invention is illustrated in FIG. 1. This developing apparatus 9 includes a developer container 6 which accommodates a developer 34, a developer carrying roller 1 which transports the developer 34, and a developer regulating member 8 which controls the thickness of the developer layer on the surface of the developer carrying roller. The developing apparatus 9 may include a developer feed roller 7 when necessary.

According to the developing apparatus, the developer is transported by the developer carrying roller, and a developer having an excessively high charge quantity after development of a solid white image is removed from the surface of the developer carrying roller in a "developer removing region" formed by the gap between the surface of the developer carrying roller and the projecting part of the developer regulating member. Furthermore, the developer removed from the developer carrying roller and the developer fed from the developer container can circulate together to provide a uniform charge quantity of the developer, thus reducing ghost images.

A developer removing region having a region satisfying the relationships represented by Expressions (1), (2) and (3) in the gap between the surface of the developer carrying roller and the projecting part achieves an effect of removing the developer on the developer carrying roller and circulating the developer. Because a long narrow gap having a densely filled developer can be ensured in the developer removing region in the transportation direction of the developer (a first rotating direction b of the developer carrying roller as shown in FIG. 1 and FIG. 2), friction between the surface of the developer carrying roller and the developer occurs along with the circulation of the developer.

In the developing apparatus, the projecting part has a portion having a gap width H of 0.05 mm or more and 0.5 mm or less where H is the gap width of the gap. The portion having a gap width H of 0.05 mm or more and 0.5 mm or less has a continuous length of at least 0.8 mm or more.

If the portion has a gap width H of less than 0.05 mm, the developer is excessively densely filled, resulting in insufficient circulation of the developer and difficulties in providing uniform charge quantities of the developer removed from the developer carrying roller and the developer fed from the developer container. If the portion has a gap width H of more than 0.5 mm, the developer is not sufficiently filled into the gap region of the projecting part, resulting in insufficient friction of the developers. For this reason, the developer having an excessively high charge quantity after the development of a solid white image cannot be removed from the surface of the developer carrying roller.

The portion has a gap width H of more preferably 0.05 mm or more and 0.3 mm or less. A gap width in this range enhances the removal of the developer from the surface of the developer carrying roller and the circulation of the developer in the gap region of the projecting part.

If the surface of the developer carrying roller corresponding to the portion having a gap width H of 0.05 mm or more and 0.5 mm or less has a continuous length L of less than 0.8 mm in the rotational direction of the developer carrying roller, the time for friction of the developers is insufficient in the developer removing region. For this reason, a developer having an excessively high charge quantity after the development of a solid white image cannot be removed from the surface of the developer carrying roller. The length L can be 3.0 mm or less. At a length L of 3.0 mm or less, the developer densely filled into the developer removing region is unlikely to lift the surface of the projecting part upwards, attaining better control of the thickness of the developer layer in the developer layer thickness regulating part.

The length L is a distance in the circumferential direction illustrated in FIG. 7, for example. In other words, the length L is a distance on the developer carrying roller between two points of intersection of two straight lines 100 and 100 and the surface of the developer carrying roller, where the two straight lines 100 and 100 are formed by connection two points on the surface of the projecting part 31*c* to the center of the cross-sectional circle of the developer carrying roller, respectively.

In the portion, when a maximum value and a minimum value of the gap width H are defined as Hmax and Hmin respectively, the proportion "Hmax/Hmin" is 3.0 or less. A proportion Hmax/Hmin of more than 3.0 results in a state of the developer unevenly filled into the gap region of the projecting part. If the gap has the minimum width Hmin on the side upstream of the projecting part and the maximum width Hmax on the side downstream thereof, and the proportion Hmax/Hmin is more than 3.0, the developer easily moves in the gap region of the projecting part, and is not uniformly filled into the gap region. This results in insufficient friction of the developers, preventing the removal of the developer having an excessively high charge quantity after the development of a solid white image from the surface of the developer carrying roller. If the gap has the maximum width Hmax on the side upstream of the projecting part and the minimum width Hmin on the side downstream thereof, and the proportion Hmax/Hmin is more than 3.0, a large amount of the developer taken in the upstream portion of the gap region may be overloaded into the downstream portion of the gap region to lift the developer layer thickness regulating part upwards, generating the failure of control of the developer.

In the developing apparatus, the projecting part of the developer regulating member facing the surface of the developer carrying roller has a concave shape. A projecting part having a concave shape can ensure that the length L of the portion having a gap width H of 0.05 mm or more and 0.5 mm or less is longer. Furthermore, the surface of the projecting part can have an inwardly curved shape. A projecting part having an inwardly curved surface can ensure a long narrow gap in the rotational direction of the developer carrying roller, facilitating the friction of the developers and effectively removing the developer on the surface of the developer carrying roller.

Furthermore, the developer layer thickness regulating part can have a length (arc length) W of 1.0 mm or more and 5.0 mm or less. An increased frictional distance between the developer regulating member and the developer carrying roller can provide a uniformly high amount of charges of the developer.

[Process Cartridge]

Figure 9:
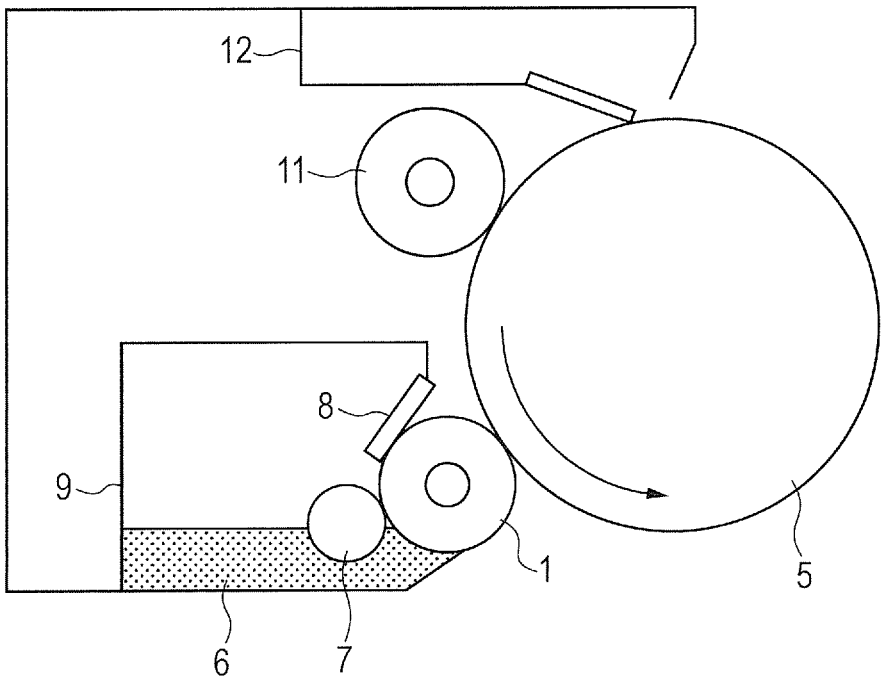
FIG. 9 is a sectional view of a schematic configuration illustrating an example of the process cartridge according to the present invention.

The process cartridge according to one aspect of the present invention is detachably attachable to the main body of the electrophotographic image forming apparatus and includes the developing apparatus according to the present invention. An example of the process cartridge according to one aspect of the present invention is illustrated in FIG. 9. The process cartridge illustrated in FIG. 9 includes a developing apparatus 9, a photosensitive member 5 and a cleaning apparatus 12, which are integrated into one. The process cartridge is detachably disposed in the main body of the electrophotographic image forming apparatus. Examples of the developing apparatus 9 include an image forming unit in the electrophotographic image forming apparatus described below. Besides the configuration above, the process cartridge according to the present invention may have a configuration in which the above-described members are integrated with a transfer member which transfers a developer image on a photosensitive member onto a recording material.

[Electrophotographic Image Forming Apparatus]

Figure 10:
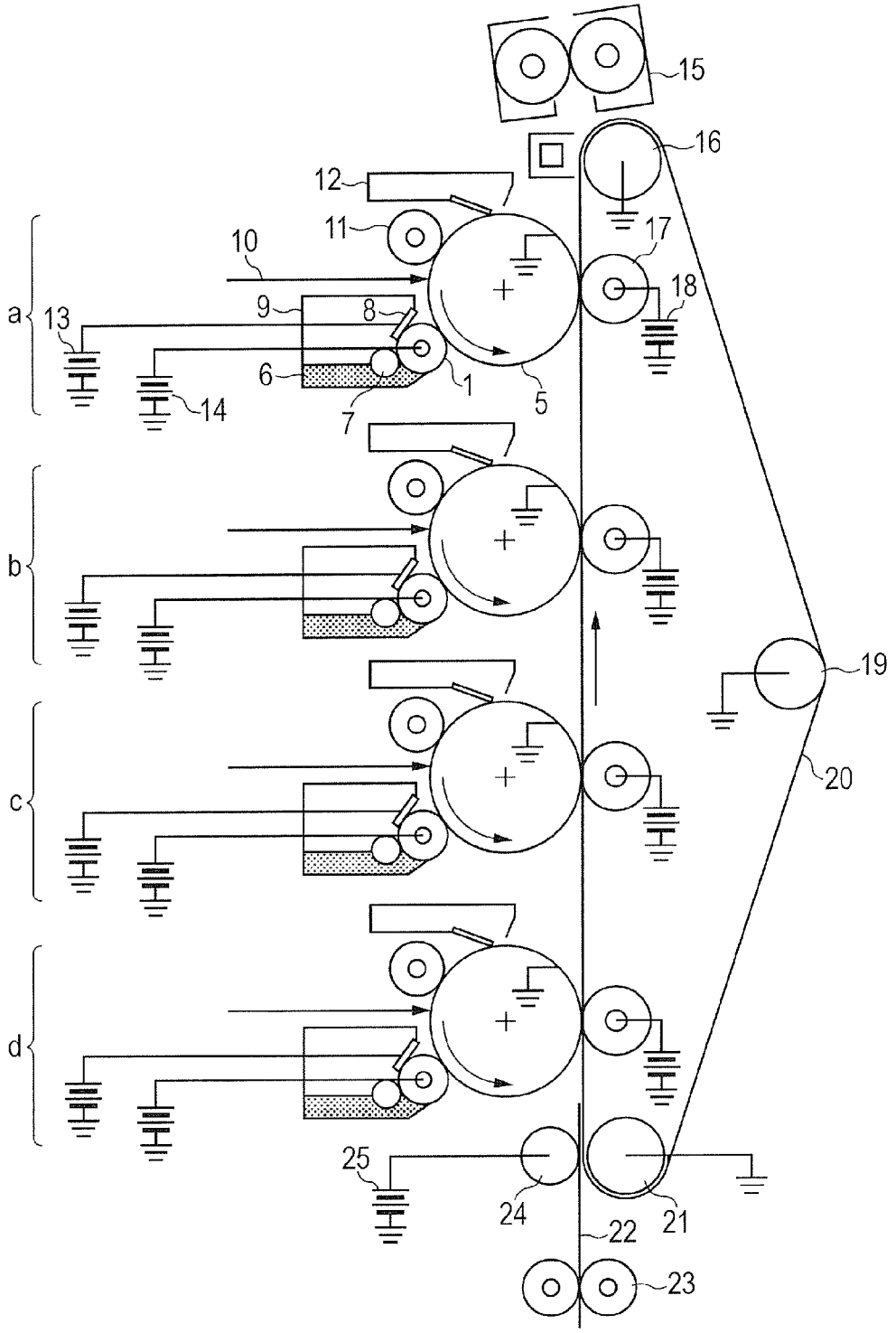
FIG. 10 is a sectional view of a schematic configuration illustrating an example of the electrophotographic image forming apparatus according to the present invention.

The electrophotographic image forming apparatus according to one aspect of the present invention includes the developing apparatus according to the present invention. An example of the electrophotographic image forming apparatus according to the present invention is illustrated in FIG. 10. In FIG. 10, the electrophotographic image forming apparatus includes image forming units a to d disposed for a yellow toner (developer), a magenta toner (developer), a cyan toner (developer) and a black toner (developer), respectively. Each of the image forming units a to d includes a photosensitive member 5 as an electrostatic latent image carrier which rotates in the arrow direction. The electrophotographic image forming apparatus includes the following disposed around each of the photosensitive members 5: a charging apparatus 11 for uniformly charging the photosensitive member 5, an exposing unit (not illustrated) for irradiating the uniformly charged photosensitive member 5 with laser light 10 to form an electrostatic latent image, and a developing apparatus 9 for feeding a developer to the photosensitive member 5 having the electrostatic latent image thereon to develop the electrostatic latent image.

A transfer conveying belt 20 for transporting a recording material 22 fed by a feed roller 23, such as paper, is extended around a driving roller 16, a following roller 21 and a tension roller 19. The transfer conveying belt 20 is charged through an adsorption roller 24 from an adsorption bias power supply 25 to electrostatically attach the recording material 22 onto the surface of the transfer conveying belt for transportation of the recording material.

The image forming units a to d each include transfer bias power supplies 18, which apply charges for transferring the developer images on the photosensitive members 5 to the recording material 22 transported by the transfer conveying belt 20. The transfer bias is applied through transfer rollers 17 disposed on the rear surface of the transfer conveying belt 20. The developer images of the respective colors formed in the image forming units a to d are sequentially transferred to be superimposed on the recording material 22 transported by the transfer conveying belt 20 driven in synchronization with the image forming units a to d.

The color electrophotographic image forming apparatus further includes a fixing apparatus 15 for fixing the developer images transferred and superimposed on the recording material 22 by heating, and a conveying apparatus (not illustrated) for discharging the recording material 22 having the formed image to the outside of the color electrophotographic image forming apparatus. The image forming units each include a cleaning apparatus 12 having a cleaning blade for removing transfer residual developers not transferred and left on the photosensitive member 5 to clean the surface of the photosensitive member 5. The cleaned photosensitive members 5 are set to be in an image formable state and are in stand-by mode.

The image forming units include the developing apparatuses 9. Each of the developing apparatuses 9 includes a developer container which accommodates a developer, and a developer carrying roller 1 disposed so as to cover the opening of the developer container and having a portion exposed from the developer container and facing the photosensitive member 5. The inside of the developer container includes a developer feed roller 7 for feeding the developer 34 to the developer carrying roller 1 and scraping the residual developer not used and left on the developer carrying roller 1 after development at the same time, and a developer regulating member 8 for forming the developer on the developer carrying roller 1 into the form of a thin film and frictionally charging the developer at the same time. The developer feed roller 7 and the developer regulating member 8 are disposed in abutment with the developer carrying roller 1. The developer carrying roller 1 and the developer feed roller 7 rotate in the forward direction.

According to one aspect of the present invention, the developing apparatus can be provided which provides a uniform charging state of the developer on the developer carrying roller to reduce the generation of ghost images attributed to the difference in the charging state of the developer on the developer carrying roller. According to another aspect of the present invention, a process cartridge and an electrophotographic image forming apparatus which can provide stable electrophotographic images can be provided.

EXAMPLES

The present invention will now be more specifically described by way of Production Examples and Examples. The term "distal end" of the projecting part of the developer regulating member refers to the end in the X-direction in FIG. 2, and the term "base" of the projecting part of the developer regulating member refers to the position at the boundary between the developer layer thickness regulating part and the projecting part.

Example 1

1. Preparation of Developer Regulating Member

A polyester thermoplastic resin (TPEE) (manufactured by Du Pont-Toray Co., Ltd.; trade name: Hytrel 4047N) was used as a material for a blade member. A supporting member used was formed of an SUS-304-1/2H material in the form of a long sheet having a length in the lateral direction of 15.2 mm and a thickness of 0.08 mm.

Figure 11:
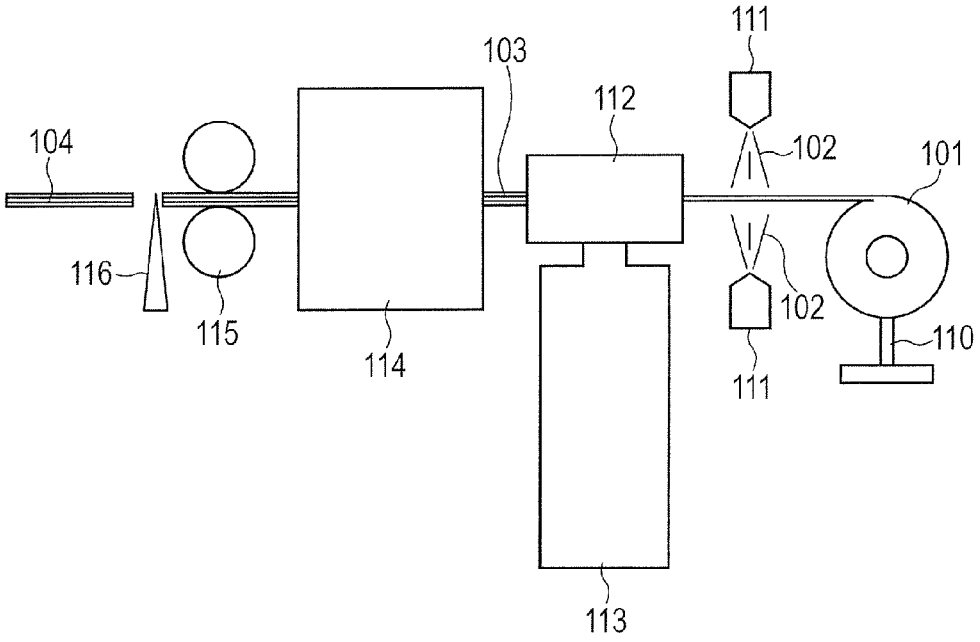
FIG. 11 is an example of an apparatus manufacturing a developer regulating member.

FIG. 11 is an apparatus for manufacturing a developer regulating member. The material for a blade member was first melted in an extrusion molding machine 113 at 200° C., and was injected to a molding cavity of a metal mold 112 for extrusion. At the same time, while the supporting member was traveling through the molding cavity of the metal mold for extrusion, one end surface of the supporting member in the lateral direction was coated with the material for a blade member. The temperature of the metal mold 112 was set at 250° C.

The blade member discharged from the metal mold 112 for extrusion was solidified by a cooler 114 to prepare a member having an abutting support surface, a distal end surface, and a surface opposite to the abutting support surface of the supporting member which were covered with the blade member. This member was cut into a length of 226 mm in the longitudinal direction by a cutter 116, and the surface facing a developer carrying roller was then processed to prepare developer regulating member No. 1 illustrated in FIG. 5 including a projecting part having a surface curvature radius R of 6.20 mm and a length $L_0$ of 1.0 mm.

2. Preparation of Developer Carrying Roller

A substrate was provided, which included a SUS304 shaft core having an outer diameter of 6 mm and a length of 270 mm and a primer (trade name: DY35-051; manufactured by Dow Corning Toray Co., Ltd.) applied and burned thereto. The substrate was disposed in a metal mold. An addition-type silicone rubber composition prepared through mixing the materials shown in Table 1 below was injected into the cavity defined in the metal mold.

TABLE 1

| Materials | Parts by mass |
|---|---|
| Liquid silicone rubber material (trade name: SE6724A/B, manufactured by Dow Corning Toray Co., Ltd.) | 100 |
| Carbon black (trade name: TOKABLACK #7360SB, manufactured by Tokai Carbon Co., Ltd.) | 20 |
| Platinum catalyst | 0.1 |

Subsequently, the silicone rubber composition was cured by heating the metal mold at a temperature of 150° C. for 15 minutes. The product was removed from the mold, and was further heated at a temperature of 180° C. for 1 hour to complete the curing reaction. A conductive elastic roller including a substrate and a conductive elastic layer having a thickness of 3 mm and disposed on the outer periphery of the substrate was prepared. Next, the materials shown in Table 2 below were weighed, and 100 parts by mass of methyl ethyl ketone was added. These materials were dispersed with a bead mill to prepare a surface layer coating solution.

TABLE 2

| Materials | Parts by mass |
|---|---|
| Polyol (trade name: N5120, manufactured by Nippon Polyurethane Industry Co., Ltd.) | 87 |
| Isocyanate (trade name: L-55E, manufactured by Nippon Polyurethane Industry Co., Ltd.) | 13 |
| Carbon black (trade name: MA77, manufactured by Mitsubishi Chemical Corporation) | 20 |
| Acrylic particle (trade name: G-800 Transparent, manufactured by Negami Chemical Industrial Co., Ltd.) | 50 |

Subsequently, the upper end of the substrate in the conductive elastic roller was held such that the longitudinal direction of the conductive elastic roller was aligned in the vertical direction. The conductive elastic roller was immersed in the surface layer coating solution, and was coated by dipping so as to have a film thickness of 10.0 μm. The immersion time was 9 seconds. The take-up rate of the workpiece from the coating solution was the initial take-up rate of 30 mm/s and the final take-up rate of 20 mm/s. The take-up rate between the initial take-up rate and the final take-up rate was linearly varied relative to the time. The workpiece was dried in an oven at a temperature of 80° C. for 15 minutes, and was heated in an oven at a temperature of 140° C. for 2 hours to perform a curing reaction. A surface layer was thereby formed to prepare developer carrying roller No. 1 having a curvature radius DR of 6.0 mm.

3. Preparation of Developing Apparatus

Developer regulating member No. 1 and developer carrying roller No. 1 were attached to the developing apparatus illustrated in FIG. 1, and were set such that the maximum width Hmax and the minimum width Hmin of the gap were both 0.2 mm, the proportion Hmax/Hmin was 1.0, and the continuous length L of the gap satisfying the relationships represented by Expressions (1) and (2) in the rotational direction of the surface of the developer carrying roller (hereinafter, referred to as a "length L of the developer removing region") was 1.0 mm.

4. Measurement of Shape of Gap Between Developer Regulating Member and Developer Carrying Roller FIG. 7 is a cross-sectional view of an abutting part between the developer regulating member and the developer carrying roller seen in a direction perpendicular to the longitudinal direction of the developer regulating member. The view was magnified 500 times using a digital microscope (manufactured by Keyence Corporation; VHX-5000). The length L of a gap having a gap width H of 0.05 mm or more and 0.5 mm or less and a proportion Hmax/Hmin of 3.0 or less was measured on the surface of the developer carrying roller. The measurement was performed at a pitch of 0.1 mm along the surface of the developer carrying roller.

5. Evaluation of Ghost Using Electrophotographic Image Forming Apparatus

Developer carrying roller No. 1 and developer regulating member No. 1 were integrated into a developing apparatus of a process cartridge for an electrophotographic image forming apparatus (trade name: CLJ CP4525, manufactured by Hewlett-Packard Company). The electrophotographic image forming apparatus was left under a low temperature and low humidity environment at a temperature of 15° C. and a relative humidity of 10% for 24 hours. Next, an image for evaluation was printed to evaluate developing ghost.

The determination of developing ghost was performed using an image for evaluation in which a solid black patch of 5 mm×5 mm was printed at an interval of 10 mm in the leading end of a sheet, and a halftone image was then printed. In this image, the density of the halftone image in a pitch of the developer carrying roller after printing of the solid black patch and the density of the halftone image in another portion were measured using a Spectordensitometer 500 manufactured by X-Rite, Incorporated. The printed images were ranked from the difference in the density of the halftone image according to the following criteria:

Rank A: The difference in the density of the halftone image is less than 0.04.

Rank B: The difference in the density of the halftone image is 0.04 or more and less than 0.08.

Rank C: The difference in the density of the halftone image is 0.08 or more.

Examples 2 and 3

Developer regulating member No. 2 was prepared in the same manner as in Example 1 except that the curvature radius R of the surface of the projecting part facing the developer carrying roller was 6.05 mm (Example 2) or 6.50 mm (Example 3), and the length $L_0$ of the projecting part was 1.0 mm. The maximum width Hmax and the minimum width Hmin of the gap, the proportion Hmax/Hmin, and the length L of the developer removing region were set so as to form a gap shown in Table 4. Except for these, developing apparatuses were prepared, measured and evaluated in the same manner as in Example 1.

Example 4

Figure 3:
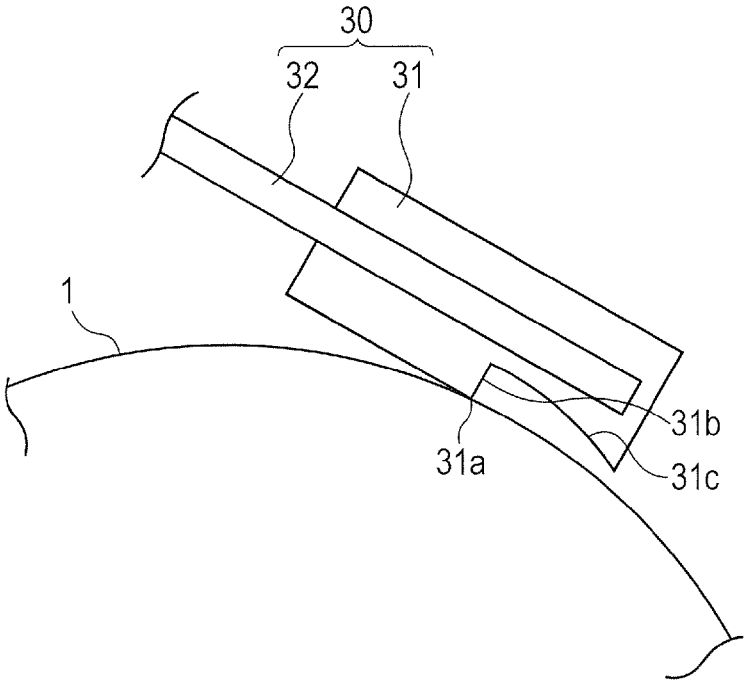
FIG. 3 is a schematic sectional view illustrating another example of the developer regulating member according to the present invention.

As illustrated in FIG. 3, developer regulating member No. 4 was prepared in the same manner as in Example 1 except that a gap was formed such that the minimum width Hmin was 0.10 mm at the distal end of the projecting part, the maximum width Hmax was 0.20 mm at the base of the projecting part, and the proportion Hmax/Hmin was 2.0. Furthermore, a developing apparatus was prepared, measured and evaluated.

Example 5

Figure 4:
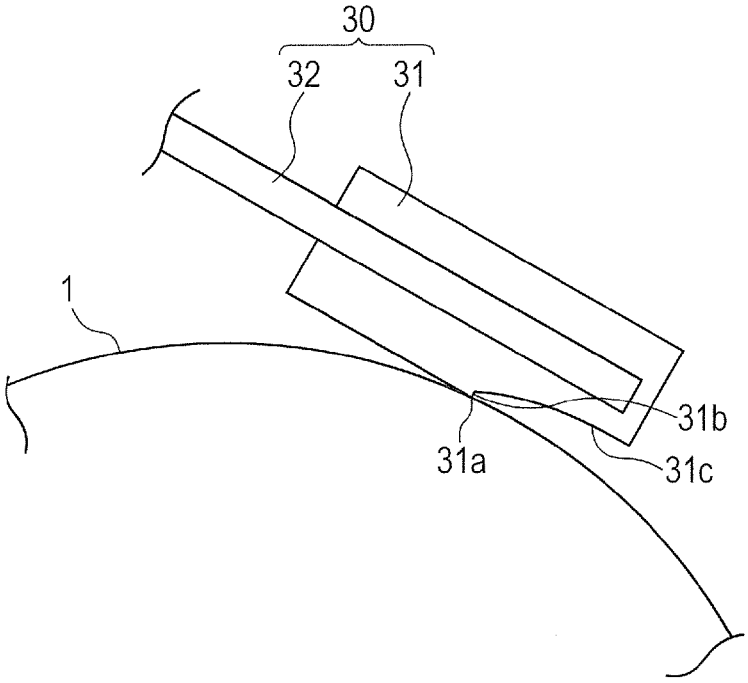
FIG. 4 is a schematic sectional view illustrating another example of the developer regulating member according to the present invention.

As illustrated in FIG. 4, developer regulating member No. 5 was prepared in the same manner as in Example 1 except that a gap was formed such that the maximum width Hmax was 0.20 mm at the distal end of the projecting part, the minimum width Hmin was 0.10 mm at the base of the projecting part, and the proportion Hmax/Hmin was 2.0. Furthermore, a developing apparatus was prepared, measured and evaluated.

Example 6

A developing apparatus was prepared in the same manner as in Example 4 except that a gap was formed such that Hmax, Hmin, and the proportion Hmax/Hmin were as shown in Table 4. The developing apparatus was measured and evaluated in the same manner as in Example 4.

Example 7

A developing apparatus was prepared in the same manner as in Example 5 except that a gap was formed such that Hmax, Hmin, and the proportion Hmax/Hmin were as shown in Table 4. The developing apparatus was measured and evaluated in the same manner as in Example 5.

Examples 8 to 10

Developer regulating members Nos. 8 to 10 were prepared in the same manner as in Example 1 except that in the developer regulating member, the curvature radius R of the surface of the projecting part facing the developer carrying roller was 6.20 mm, and the length $L_0$ of the projecting part was 0.8 mm (Example 8), 3.0 mm (Example 9) or 2.0 mm (Example 10). The length L of the developer removing region was set at 0.8 mm. Except for theses, a developing apparatus was prepared, measured and evaluated in the same manner as in Example 1.

Example 11

Figure 6A:
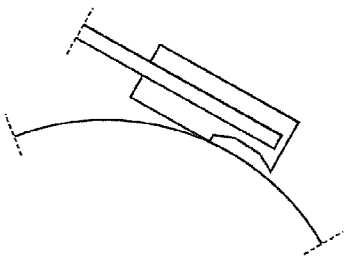
FIGS. 6A, 6B, and 6C are schematic sectional views illustrating another example of the developer regulating member according to the present invention.

As illustrated in FIG. 6A, developer regulating member No. 11 was prepared in which the surface of the projecting part facing the developer carrying roller had a bent shape, and the length $L_0$ of the projecting part was divided into three lengths, a length $L_{01}$ of the projecting part in the distal end, a length $L_{02}$ in the central projecting part, and a length $L_{03}$ of the projecting part at the base. The angle formed by $L_{01}$ and $L_{02}$ and the angle formed by $L_{02}$ and $L_{03}$ facing the surface of the developer carrying roller were 170°. Except for these, a developing apparatus was prepared, measured and evaluated in the same manner as in Example 1.

Example 12

Developer regulating member No. 12 was prepared in the same manner as in Example 1 except that the curvature radius R of the surface of the projecting part facing the developer carrying roller was 6.30 mm, and the length $L_0$ of the projecting part was 1.0 mm. Hmax was set at 0.30 mm, and Hmin was set at 0.30 mm. Except for these, a developing apparatus was prepared, measured and evaluated in the same manner as in Example 1.

Example 13

Developer regulating member No. 13 was prepared in the same manner as in Example 4 except that the curvature radius R of the surface of the projecting part facing the developer carrying roller was 6.30 mm, the length $L_0$ of the projecting part was 1.0 mm, and as illustrated in FIG. 3, a gap was formed to have an Hmin of 0.10 mm at the distal end of the projecting part, an Hmax of 0.30 mm in the projecting part facing the developer layer thickness regulating part, and a proportion Hmax/Hmin of 3.0. In the next step, a developing apparatus was prepared, measured and evaluated in the same manner as in Example 1.

Example 14

Developer regulating member No. 14 was prepared in the same manner as in Example 5 except that the curvature radius R of the surface of the projecting part facing the developer carrying roller was 6.30 mm, the length $L_0$ of the projecting part was 1.0 mm, and as illustrated in FIG. 4, a gap was formed to have an Hmax of 0.30 mm at the distal end of the projecting part, an Hmin of 0.10 mm in the projecting part facing the developer layer thickness regulating part, and a proportion Hmax/Hmin of 3.0. In the next step, except for these, a developing apparatus was prepared, measured and evaluated in the same manner as in Example 1.

Examples 15 to 17

Developer regulating members No. 15 to 17 were prepared in the same manner as in Example 1 except that the length W of the developer layer thickness regulating part was 1.0 mm (Example 15), 3.0 mm (Example 16) or 5.0 mm (Example 17). In the next step, developing apparatuses were prepared, measured and evaluated in the same manner as in Example 1.

Example 18

A developing apparatus was prepared in the same manner as in Example 1 except that the curvature radius R of the surface of the projecting part facing the developer carrying roller was 6.20 mm, and the length $L_0$ of the projecting part was 4.0 mm. The developing apparatus was measured and evaluated in the same manner as in Example 1.

Example 19

Figure 6B:
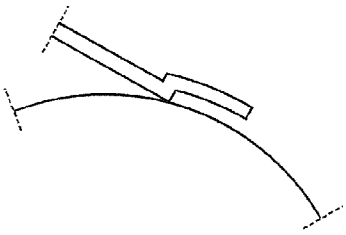

This Example is an exemplary developer regulating member illustrated in FIG. 6B in which the supporting member and the blade member are formed of the same material.

1. Preparation of Developer Regulating Member

Two materials shown in Component (1) of Table 3 below were reacted under stirring at a temperature of 80° C. for 3 hours to prepare a prepolymer (NCO %: 8.50%). Five materials shown in Component (2) of Table 3 were mixed with the prepolymer to prepare a polyurethane elastomer raw material composition. The composition was injected into the cavity of a metal mold for molding, and was cured at a temperature of 130° C. over 2 minutes. The product was removed from the mold to prepare an elastic member. The elastic member was cut into a dimension of 226 mm in the longitudinal direction, 15.2 mm in the lateral direction, and a thickness of 2.0 mm. In the next step, the elastic member was further processed to prepare developer regulating member No. 19 illustrated in FIG. 6B in which the curvature radius R of the surface of the projecting part facing the developer carrying roller was 6.20 mm, and the length $L_0$ of the projecting part was 1.0 mm.

TABLE 3

| | Abbreviation | Materials | Amount used |
|---|---|---|---|
| Component (1) | MDI | 4,4'-Diphenylmethane diisocyanate (trade name; Millionate MT, manufactured by Tosoh Corporation) | 326.3 |
| | PBA | Polybutylene adipate polyester polyol having number average molecular weight of 2500 | 673.7 |
| Component (2) | PHA | Polyhexylene adipate polyester polyol having number average molecular weight of 1000 | 150.8 |
| | 14BD | 1,4-Butanediol | 26.2 |
| | TMP | Trimethylolpropane | 21.4 |
| | Catalyst A | Polycat46 (trade name, available from Air Products Japan K.K) | 0.07 |
| | Catalyst B | N,N-Dimethylaminohexanol (trade name; KAOLIZER No. 25, manufactured by Kao Corporation) | 0.28 |

2. Preparation and Evaluation of Developing Apparatus

A developing apparatus was prepared in the same manner as in Example 1 except that the developer regulating member was used. The developing apparatus was measured and evaluated in the same manner as in Example 1.

Example 20

Figure 6C:
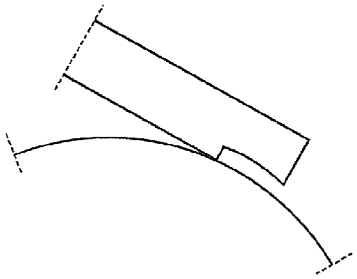

A developer regulating member including a supporting member and a blade member formed of the same material as illustrated in FIG. 6C was used. Developer regulating member No. 20 was prepared by pressing a member made of an SUS-304-1/2H material into a dimension of 15.2 mm in the lateral direction, 226 mm in the longitudinal direction, and a thickness of 0.08 mm. Except for these, a developer carrying roller and a developer regulating member were incorporated in a developing apparatus in the same manner as in Example 1. The measurement and the evaluation were performed in the same manner as in Example 1.

The configurations of the members, the measured values, and the results of evaluation in the Examples are shown in Table 4.

Comparative Example 1

Developer regulating member No. 21 was prepared in which the surface of the projecting part facing the developer carrying roller had a linear shape, and a gap was formed to have a minimum width Hmin of 0.20 mm in the central portion of the surface of the projecting part. Except for these, a developer carrying roller and a developer regulating member were incorporated in a developing apparatus in the same manner as in Example 1. The measurement and the evaluation were performed in the same manner as in Example 1.

Comparative Example 2

A developer regulating member was set such that the curvature radius R was 6.03 mm, and a gap was formed to have a maximum width Hmax of 0.03 mm and a minimum width Hmin of 0.03 mm. Except for these, a developing apparatus was prepared, measured and evaluated in the same manner as in Example 1.

Comparative Example 3

A developer regulating member was set such that the curvature radius R was 6.60 mm, and a gap was formed to have a maximum width Hmax of 0.6 mm and a minimum width Hmin of 0.6 mm. Except for these, a developing apparatus was prepared, measured and evaluated in the same manner as in Example 1.

Comparative Example 4

A developer regulating member was set such that the length $L_0$ of the projecting part was 0.5 mm, and a gap was formed to have a length L of the developer removing region of 0.5 mm. Except for these, a developing apparatus was prepared, measured and evaluated in the same manner as in Example 1.

Comparative Example 5

A developing apparatus was prepared in the same manner as in Example 1 except that as illustrated in FIG. 3, a gap was formed to have a minimum width Hmin of 0.05 mm at the distal end of the projecting part, a maximum width Hmax of 0.20 mm at the base of the projecting part, and a proportion Hmax/Hmin of 4.0. The developing apparatus was measured and evaluated in the same manner as in Example 1.

Comparative Example 6

A developing apparatus was prepared in the same manner as in Example 1 except that as illustrated in FIG. 4, a gap was formed to have a maximum width Hmax of 0.20 mm at the distal end of the projecting part, a minimum width Hmin of 0.05 mm, and a proportion Hmax/Hmin of 4.0. The developing apparatus was measured and evaluated in the same manner as in Example 1.

The configurations of the members, the measured values, and the results of evaluation in the Comparative Examples are shown in Table 5.

TABLE 4

| Example | Developer regulating member No. | Shape of surface of projecting part | Material for blade member | Length L of developer removing region mm | Length W of layer thickness regulating part mm | Curvature radius R of surface of projecting part mm | Radius DR of developer carrying roller mm |
|---|---|---|---|---|---|---|---|
| 1 | 1 | Curved | TPEE | 1.0 | 0.5 | 6.20 | 6.0 |
| 2 | 2 | Curved | TPEE | 1.0 | 0.5 | 6.05 | 6.0 |
| 3 | 3 | Curved | TPEE | 1.0 | 0.5 | 6.50 | 6.0 |
| 4 | 4 | Curved | TPEE | 1.0 | 0.5 | 6.20 | 6.0 |
| 5 | 5 | Curved | TPEE | 1.0 | 0.5 | 6.20 | 6.0 |
| 6 | 6 | Curved | TPEE | 1.0 | 0.5 | 6.20 | 6.0 |
| 7 | 7 | Curved | TPEE | 1.0 | 0.5 | 6.20 | 6.0 |
| 8 | 8 | Curved | TPEE | 0.8 | 0.5 | 6.20 | 6.0 |
| 9 | 9 | Curved | TPEE | 3.0 | 0.5 | 6.20 | 6.0 |
| 10 | 10 | Curved | TPEE | 2.0 | 0.5 | 6.20 | 6.0 |
| 11 | 11 | Bent | TPEE | 1.0 | 0.5 | — | 6.0 |
| 12 | 12 | Curved | TPEE | 1.0 | 0.5 | 6.30 | 6.0 |
| 13 | 13 | Curved | TPEE | 1.0 | 0.5 | 6.30 | 6.0 |
| 14 | 14 | Curved | TPEE | 1.0 | 0.5 | 6.30 | 6.0 |
| 15 | 15 | Curved | TPEE | 1.0 | 1.0 | 6.20 | 6.0 |
| 16 | 16 | Curved | TPEE | 1.0 | 3.0 | 6.20 | 6.0 |
| 17 | 17 | Curved | TPEE | 1.0 | 5.0 | 6.20 | 6.0 |
| 18 | 18 | Curved | TPEE | 4.0 | 0.5 | 6.20 | 6.0 |
| 19 | 19 | Curved | Thermosetting polyurethane | 1.0 | 0.5 | 6.20 | 6.0 |
| 20 | 20 | Curved | SUS | 1.0 | 0.5 | 6.20 | 6.0 |

| | Gap width H | | | | | | |
|---|---|---|---|---|---|---|---|
| Example | Distal end mm | Center mm | Base mm | Maximum Hmax mm | Minimum Hmin mm | Proportion Hmax/Hmin — | Evaluation of ghost images |
| 1 | 0.20 | 0.20 | 0.20 | 0.20 | 0.20 | 1.0 | A |
| 2 | 0.05 | 0.05 | 0.05 | 0.05 | 0.05 | 1.0 | A |
| 3 | 0.50 | 0.50 | 0.50 | 0.50 | 0.50 | 1.0 | B |
| 4 | 0.10 | 0.15 | 0.20 | 0.20 | 0.10 | 2.0 | A |
| 5 | 0.20 | 0.15 | 0.10 | 0.20 | 0.10 | 2.0 | A |
| 6 | 0.07 | 0.14 | 0.21 | 0.21 | 0.07 | 3.0 | B |
| 7 | 0.21 | 0.14 | 0.07 | 0.60 | 0.21 | 3.0 | B |
| 8 | 0.20 | 0.20 | 0.20 | 0.20 | 0.20 | 1.0 | A |
| 9 | 0.20 | 0.20 | 0.20 | 0.20 | 0.20 | 1.0 | A |
| 10 | 0.20 | 0.20 | 0.20 | 0.20 | 0.20 | 1.0 | A |
| 11 | 0.18 | 0.22 | 0.18 | 0.22 | 0.18 | 1.2 | B |
| 12 | 0.30 | 0.30 | 0.30 | 0.30 | 0.30 | 1.0 | A |
| 13 | 0.10 | 0.20 | 0.30 | 0.30 | 0.10 | 3.0 | A |
| 14 | 0.30 | 0.20 | 0.10 | 0.30 | 0.10 | 3.0 | A |
| 15 | 0.20 | 0.20 | 0.20 | 0.20 | 0.20 | 1.0 | A |
| 16 | 0.20 | 0.20 | 0.20 | 0.20 | 0.20 | 1.0 | A |
| 17 | 0.20 | 0.20 | 0.20 | 0.20 | 0.20 | 1.0 | A |
| 18 | 0.20 | 0.20 | 0.20 | 0.20 | 0.20 | 1.0 | B |
| 19 | 0.20 | 0.20 | 0.20 | 0.20 | 0.20 | 1.0 | B |
| 20 | 0.20 | 0.20 | 0.20 | 0.20 | 0.20 | 1.0 | B |

TABLE 5

| Comparative Example | Developer regulating member No. | Shape of surface of projecting part | Material for blade member | Length L of developer removing region mm | Length W of layer thickness regulating part mm | Curvature radius R of surface of projecting part mm | Radius DR of developer carrying roller mm |
|---|---|---|---|---|---|---|---|
| 1 | 21 | Linear | TPEE | 1.0 | 0.5 | — | 6.0 |
| 2 | 22 | Curved | TPEE | 1.0 | 0.5 | 6.03 | 6.0 |
| 3 | 23 | Curved | TPEE | 1.0 | 0.5 | 6.60 | 6.0 |
| 4 | 24 | Curved | TPEE | 0.5 | 0.5 | 6.20 | 6.0 |
| 5 | 25 | Curved | TPEE | 1.0 | 0.5 | 6.20 | 6.0 |
| 6 | 26 | Curved | TPEE | 1.0 | 0.5 | 6.20 | 6.0 |

TABLE 5-continued

| Comparative Example | Gap width H: Distal end mm | Center mm | Base mm | Maximum Hmax mm | Minimum Hmin mm | Proportion Hmax/Hmin — | Evaluation of ghost images |
|---|---|---|---|---|---|---|---|
| 1 | 0.22 | 0.20 | 0.22 | 0.22 | 0.20 | 1.1 | C |
| 2 | 0.03 | 0.03 | 0.03 | 0.03 | 0.03 | 1.0 | C |
| 3 | 0.60 | 0.60 | 0.60 | 0.60 | 0.60 | 1.0 | C |
| 4 | 0.20 | 0.20 | 0.20 | 0.20 | 0.20 | 1.0 | C |
| 5 | 0.05 | 0.13 | 0.20 | 0.20 | 0.05 | 4.0 | C |
| 6 | 0.20 | 0.13 | 0.05 | 0.20 | 0.05 | 4.0 | C |

As described above, the developing apparatus according to the present invention can reduce the generation of ghost images because a side of the projecting part of the developer regulating member facing the developer carrying roller has an inwardly curved surface, and the developing apparatus includes the developer removing region satisfying all of the relationships represented by Expressions (1), (2) and (3).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150121, filed Jul. 29, 2016, which is hereby incorporated by reference herein in its entirety.

What is claimed is:

1. A developing apparatus comprising:

a developer carrying roller rotatable in a first rotating direction, and a developer regulating member which controls a thickness of a developer layer carried on a surface of the developer carrying roller, wherein the developer regulating member has a developer layer thickness regulating part and a projecting part, the developer regulating member has a part abutting with the surface of the developer carrying roller at the developer layer thickness regulating part, the projecting part is extending towards an upstream side in the first rotating direction from the abutting part, the projecting part and the surface of the developer carrying roller form a non-contacting gap therebetween, when a width of the gap is defined as H, the gap has a portion where a gap width H satisfies Expression (1):

$$0.05\ \text{mm} \le H \le 0.5\ \text{mm}; \qquad \text{Expression (1)}$$

when a maximum value and a minimum value of the gap width H in the portion are defined as Hmax and Hmin respectively, Hmax and Hmin satisfy Expression (2):

$$H\text{max}/H\text{min} \le 3.0; \qquad \text{Expression (2)}$$

and the portion has a continuous length L which satisfies Expression (3):

$$L \ge 0.8\ \text{mm, and wherein} \qquad \text{Expression (3)}$$

the projecting part has a concave shape at a side facing the developer carrying roller that follows an arc-shaped surface of the developer carrying roller, and forms the portion having the gap width H and the continuous length L.

2. The developing apparatus according to claim 1, wherein a level difference is disposed between the developer layer thickness regulating part and the projecting part.

3. The developing apparatus according to claim 1, wherein the gap width H is 0.05 mm or more and 0.3 mm or less.

4. The developing apparatus according to claim 1, wherein the length L is 3.0 mm or less.

5. The developing apparatus according to claim 1, the developer layer thickness regulating part in the rotational direction of the developer carrying roller has a length W of 1.0 mm or more and 5.0 mm or less.

6. The developing apparatus according to claim 1, wherein the developer regulating member comprises a supporting member and a blade member, and the blade member has the developer layer thickness regulating part and the projecting part.

7. The developing apparatus according to claim 6, wherein the blade member is disposed at one end of the supporting member, the blade member comprising an elastic material, and the supporting member extends to a position of the projecting part.

8. The developing apparatus according to claim 7, wherein the elastic member comprises a thermoplastic elastomer.

9. A process cartridge detachably attachable to a main body of an electrophotographic image forming apparatus, the process cartridge comprising a developing apparatus, wherein the developing apparatus comprises a developer carrying roller rotatable in a first rotating direction, and a developer regulating member which controls a thickness of a developer layer carried on a surface of the developer carrying roller, the developer regulating member has a developer layer thickness regulating part and a projecting part, the developer regulating member has a part abutting with the surface of the developer carrying roller at the developer layer thickness regulating part, the projecting part is extending towards an upstream side in the first rotating direction from the abutting part, the projecting part and the surface of the developer carrying roller form a non-contacting gap therebetween, when a width of the gap is defined as H, the gap has a portion where a gap width H satisfies Expression (1):

$$0.05\ \text{mm} \le H \le 0.5\ \text{mm}; \qquad \text{Expression (1)}$$

when a maximum value and a minimum value of the gap width H in the portion are defined as Hmax and Hmin respectively, Hmax and Hmin satisfy Expression (2):

$$H\text{max}/H\text{min} \le 3.0; \qquad \text{Expression (2)}$$

and the portion has a continuous length L which satisfies Expression (3):

$L \geq 0.8$ mm, and wherein Expression (3)

the projecting part has a concave shape at a side facing the developer carrying roller that follows an arc-shaped surface of the developer carrying roller and forms the portion having the gap width H and the continuous length L.

10. An electrophotographic image forming apparatus comprising a developing apparatus, wherein the developing apparatus comprises a developer carrying roller rotatable in a first rotating direction, and a developer regulating member which controls a thickness of a developer layer carried on a surface of the developer carrying roller, the developer regulating member has a developer layer thickness regulating part and a projecting part, the developer regulating member has a part abutting with the surface of the developer carrying roller at the developer thickness regulating part, the projecting part is extending towards an upstream side in the first rotating direction from the abutting part, the projecting part and the surface of the developer carrying roller form a non-contacting gap therebetween when a width of the gap is defined as H, the gap has a portion where a gap width satisfies Expression (1):

$0.05 \text{ mm} \leq H \leq 0.5 \text{ mm}$ Expression (1)

when a maximum value and a minimum value of the gap width H in the portion are defined as Hmax and Hmin respectively, Hmax and Hmin satisfy Expression (2):

$H\text{max}/H\text{min} \leq 3.0$; Expression (2)

and the portion has a continuous length L which satisfies Expression (3):

$L \geq 0.8$ mm, wherein Expression (3)

the projecting part has a concave shape at a side facing the developer carrying roller that follows an arc-shaped surface of the developer carrying roller and forms the portion having the gap width H and the continuous length L.

11. A developing apparatus comprising:

a developer carrying roller rotatable in a first rotating direction, and a developer regulating member which controls a thickness of a developer layer carried on a surface of the developer carrying roller, wherein the developer regulating member has developer layer thickness regulating part, and a projecting part, the developer layer thickness regulating part has a part abutting with the surface of the developer carrying roller at the developer layer thickness regulating part, and the projecting part has an inwardly curved surface at a side facing the developer carrying member, wherein the projecting part and the surface of the developer carrying roller form a non-contacting gap therebetween at an upstream side in the first rotating direction from the abutting part, and wherein when a width of the gap is defined as H, and a maximum value and a minimum value of the gap width are defined as Hmax and Hmin respectively, H, Hmax and Hmin satisfy Expression (1) and Expression (2):

$0.05 \text{ mm} \leq H \leq 0.5 \text{ mm}$ Expression (1)

$H\text{max}/H\text{min} \leq 3.0$; Expression (2)

and the gap has a continuous length L in the first rotational direction, the continuous length L satisfying Expression (3):

$L \geq 0.8$ mm. Expression (3)

* * * * *